United States Patent [19]

Foshee et al.

[11] Patent Number: 4,589,691

[45] Date of Patent: May 20, 1986

[54] LEVER HANDLE MORTISE LOCK

[75] Inventors: William R. Foshee; Kevin Carey, both of Indianapolis, Ind.

[73] Assignee: Best Lock Corporation, Indianapolis, Ind.

[21] Appl. No.: 607,007

[22] Filed: May 4, 1984

[51] Int. Cl.[4] ..... E05C 1/16

[52] U.S. Cl. ..... 292/165; 292/DIG. 61; 292/150

[58] Field of Search ..... 292/165, 167, 173, 222, 292/336.3, 247, DIG. 61, 150

[56] References Cited

U.S. PATENT DOCUMENTS

| | | | |
|---|---|---|---|
| 91,174 | 6/1869 | Slaight | 292/165 |
| 1,513,094 | 10/1924 | Devereaux | 292/165 |
| 1,900,328 | 3/1933 | Boggs | 292/165 X |
| 2,494,478 | 1/1950 | Kuzma | 292/165 |
| 2,596,949 | 5/1952 | Welch et al. | 292/222 |
| 3,750,433 | 8/1973 | Sanders | 292/165 X |

*Primary Examiner*—Richard E. Moore

*Attorney, Agent, or Firm*—Barnes & Thornburg

[57] ABSTRACT

An improved mortise lock is provided with spring means for independently returning each of the inside and outside lever handles from a rotated operating position. Inside and outside operating hubs are independently rotatably mounted in the case. A retraction lever extends from a pivot past the hubs and into retracting engagement with the tailpiece of the latch bolt. Rotation of one of the operating hubs causes a cam flange thereon to engage the retraction lever to pivot the retraction lever rearward to retract the latch bolt. In one embodiment, a complementary pair of inside and outside hub bias arms are pivotally mounted in the case in side-by-side relation. Each bias arm is biased against its companion hub to return the hub from a rotated lock-operating position. In another embodiment, a single hub bias arm is biased against either the inside or the outside hub.

18 Claims, 10 Drawing Figures

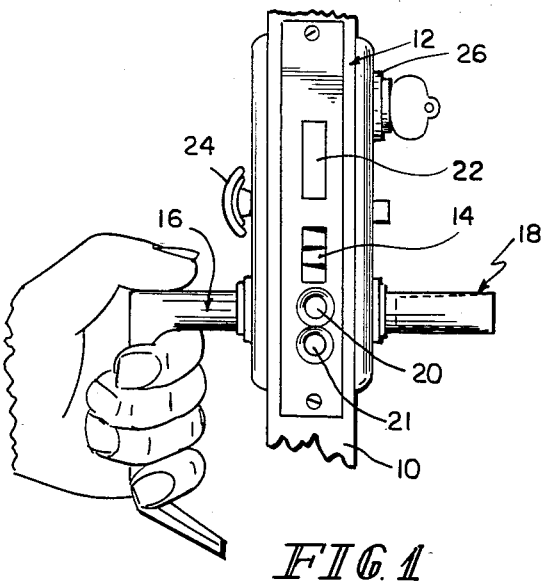
FIG. 1
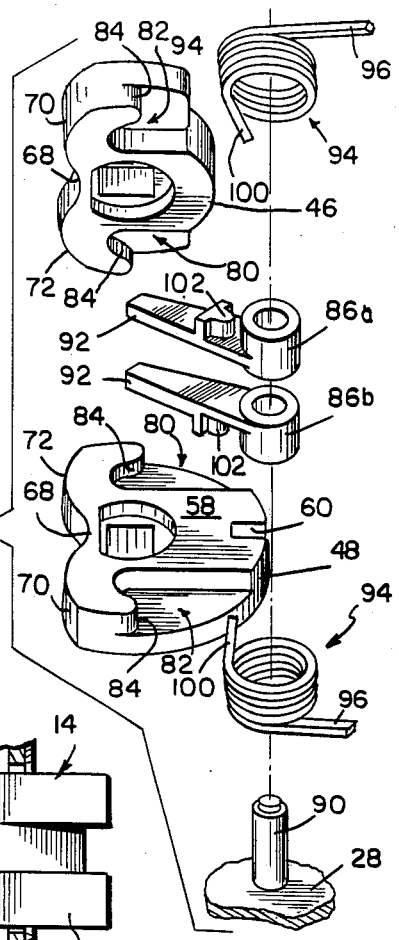
FIG. 4
FIG. 2
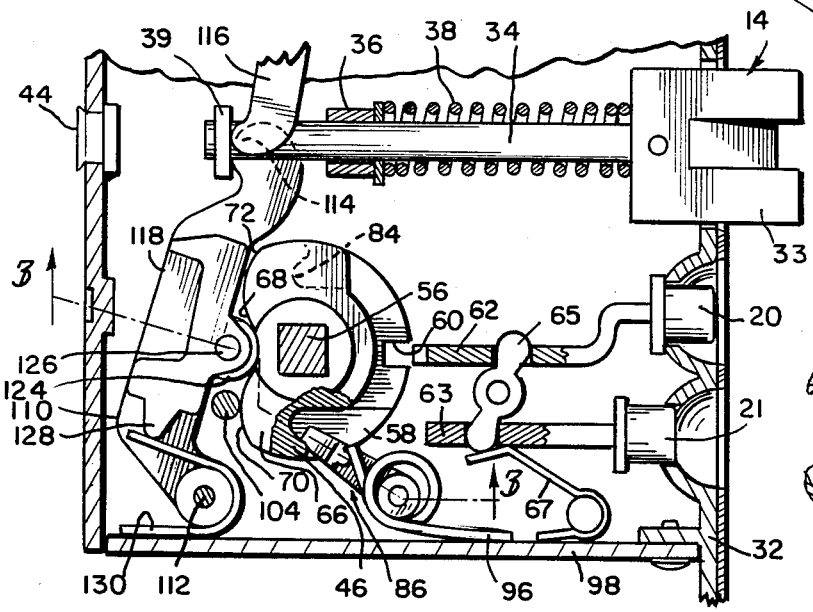
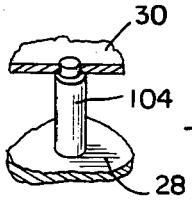
FIG. 5
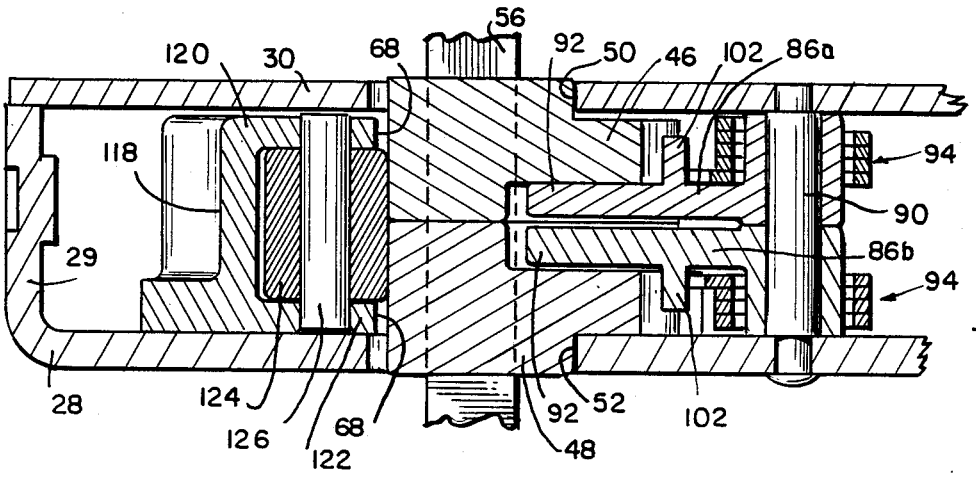
FIG. 3

LEVER HANDLE MORTISE LOCK

This invention relates to a mortise lock, and particularly to a lock having a complementary pair of inside and outside lock-operating hubs such that each hub is rotatable to operate the lock by movement of either a lever handle or a knob carried thereon. More particularly, the present invention relates to spring means for yieldably biasing only the hub or hubs carrying lever handles or the like to independently return each lever handle from its rotated lock-operating position.

Lever handles are used on mortise locks to ensure that such locks are operable by persons such as handicapped persons who have difficulty operating a knob which can be turned only by tightly gripping the knob. In some states, safety laws have been adopted to mandate that the design of the conventional lever handle grip be modified so that the distal end or tip of the lever handle is positioned in close proximity to the face of the door on which the lever-handled lock is mounted. A principal object of this requirement is to prevent a cuff of a long-sleeved shirt or coat from catching or snagging on a standard lever handle during an emergency evacuation of a building. Clothing snags of this type are commonly induced by hasty operation of a lever-handled lock.

Conventional lever handles have been modified throughout the industry to conquer the clothing entanglement problem. For example, a canted end portion is added to the existing distal end or tip of the lever handle grip so that the outermost tip of the modified lever handle lies in close proximity to the adjacent door. Such a modification, while minimizing the above-described entanglement problem, is known to be responsible for causing serious damage to the conventional lever return spring used to bias both inside and outside lever handles toward their return position.

One type of conventional lock set uses a single spring for biasing a pair of independently rotatable lock-operating hubs to simultaneously return both of the inside and outside lever handles carried on each of the hubs. Use of a single "ribbon", "compression", or "torsion" spring for this purpose is known. Operation of the lock frequently causes the conventional single spring to be overstressed since it must return the unused lever handle in addition to the handle that is being manually operated.

The lever return spring of both conventional and modified lever-handled mortise lock sets is susceptible to fracture when said single spring is stressed beyond its elastic limit. Conventional lock sets outfitted with unmodified lever handles have a marked tendency to fail as a result of this type of spring failure. However, the incidence of spring failure for a modified lever handle is noticably increased since the added lever handle mass resulting from the addition of a canted handle grip end portion to a conventional lever handle further increases the moment of the unused lever handle about its axis of rotation.

Another type of known lock set uses a pair of springs for biasing a pair of independently rotatable lock-operating hubs. Only use of a pair of "ribbon" springs for this purpose is known. In such a lock set, each ribbon spring directly contacts its companion lock-operating hub and may not be disabled by a user in favor of another bias means of a type usable to return a knob instead of a lever handle. Thus, such a known lock set is obliged to use only a pair of ribbon spring biased lever handles and thus suffers an inherent disadvantage since the operation mode is not variable by a user. Such a lock set must always remain a "lever/lever" grip and may not be changed to a "lever/knob" or a "knob/knob" grip.

An improved mortise lock provided with spring means for independently returning each of the inside and outside lever handles from a rotated operating position would avoid the shortcomings of conventional lever-handled mortise locks. Such an improved lock set would be particularly desirable since independent return of each lever handle would, in effect, eliminate the increased mass moment of the unused modified lever handle as a factor contributing to the failure of conventional single springs currently used to simultaneously return both lever handles. Further, such an improved mortise lock would be easily adaptable to provide a "lever/knob" grip combination as an alternative to a "lever/lever" grip combination. It will be understood that conventional knobs require installation of a different type of return spring biasing means than the type used to return lever handles. Either the inside or outside lever handle of the improved mortise lock could be replaced by a knob since the spring means which normally returns one of the lever handles could be disabled and replaced by a conventional knob return means without impairing the operability of the spring means for returning the remaining lever handle. This enhanced capability is not available to either type of conventional mortise locks described above.

In accordance with the present invention, the latch bolt of a mortise lock, including its tailpiece, is slidably mounted between the front and the rear side walls of the lock case and biased to projected position through the edge face which is mounted at the edge of a door. Inside and outside operating hubs are rotatably mounted coaxially in the case and operable respectively by the inside and outside lever handles or knobs. A retraction lever extends from a pivot in the case past the hubs and into retracting engagement with the tailpiece of the latch bolt.

Each operating hub is formed to include at least one notch having a hub camming surface. Each hub further includes a cam flange formed with a heart-shaped cam surface including a central cam valley and opposite cam faces spiralling out from such valley in opposite directions. The cam flanges of the two hubs lie adjacent and parallel to each other. The oppositely extending spiral cam faces are operable, on rotation of one of the operating hubs, to engage the retraction lever to pivot the retraction lever rearward so as to slidably retract the latch bolt.

According to one illustrative embodiment of the present invention, a complementary pair of inside and outside hub bias arms are pivotally mounted to the case in side-by-side relation to provide a suitable "lever/lever" grip combination. Each hub bias arm includes a bias arm camming surface formed on its distal end that is operable on the hub camming surface of its companion hub. Each bias arm is loaded with a torsional hub spring to cause said bias arm normally to operate on its companion hub whereby such operation returns the companion hub from a rotated lock-operating position to subsequently cause the retraction lever to pivot forward so as to project the latch bolt through the edge face of the mortise lock.

According to another illustrative embodiment of the present invention suitable for providing a "lever/knob" grip combination, a single hub bias arm having a bias arm camming surface is pivotably mounted to the case to operate on the hub camming surface of either the inside or the outside hub. A cylindrical hub sleeve is installed to replace the removed second hub bias arm that was included in the "lever/lever" combination. The remaining single bias arm is loaded with a torsional spring to cause said bias arm to operate on only one of the two hubs in the manner described above. Thus, the other of the two hubs is operable by rotation of a conventional knob.

One advantage of the multiple handle arrangement feature taught by the present invention is an increased design flexibility and retrofit capability since the function of a single mortise lock can be changed from "lever/lever" to "lever/knob" mode merely by removing one of the two bias arms and replacing said bias arm with a cylindrical hub sleeve so that the remaining bias arm operates only on the hub which carries the lever handle and not on the hub which is altered to carry a knob rather than a lever handle. Another significant advantage of this feature is that the spring means used to bias the conventional knob in the "lever/knob" configuration is not required to return the unused lever handle in addition to the knob. Thus, one appropriate spring can be engineered and selected to return the knob and another spring to return the lever handle to significantly lessen the incidence of lock failure experienced by conventional mortise locks due to overstressing a conventional single lever return spring.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which:

FIG. 1 is an edge elevation of a door fitted with one embodiment of a mortise lock constructed in accordance with the present invention showing an inside lever handle in its operated position and an outside lever handle in its normal position;

FIG. 2 is a longitudinal vertical section showing the latch bolt retraction mechanism of the mortise lock in combination with an embodiment of the spring biased lock-operating hubs of the present invention;

FIG. 3 is a horizontal section on the line 3—3 of FIG. 2;

FIG. 4 is an exploded assembly view of the spring biased lock-operating hubs shown in FIG. 2;

FIG. 5 is an enlarged view of the long hub stop pin shown in FIG. 2;

Figure 6:
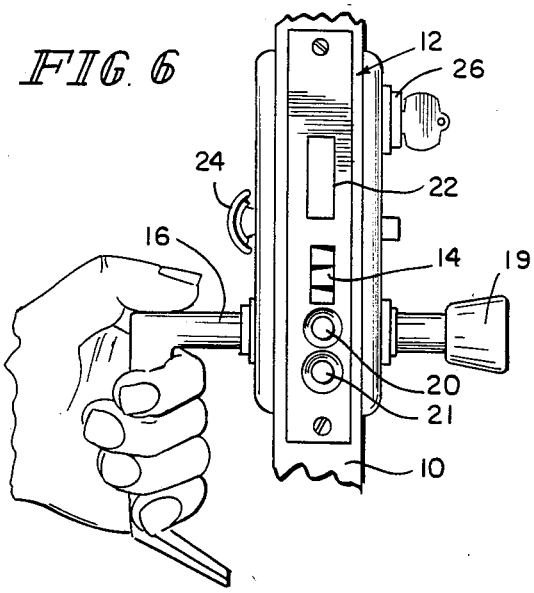
FIG. 6 is an edge elevation of a door fitted with a second embodiment of a mortise lock constructed in accordance with the present invention showing an inside lever handle in its operated position, and an outside doorknob.

The embodiment of the lock mechanism shown in FIGS. 1 to 5 comprises a mortise lock furnished with a "lever/lever" grip combination. The mortise lock includes a generally rectangular case mounted in a cavity in the edge of a door 10 with its edge face 12 exposed at such edge. The lock has a latch bolt 14 which is always operated by an inside lever handle 16 and is operable by an outside lever handle 18 when the stopwork buttons 20 and 21 are in the position shown in FIG. 2. By reversing the positions of such stopwork buttons 20 and 21, the outside lever handle 18 is locked against rotation so that it is inoperable to retract the latch bolt 14.

The lock also has a dead bolt 22 which is operable from the inside of the door by a thumbturn 24, and the lock includes a key-operated mechanism 26 which is effective both to retract the dead bolt 22 and to retract the latch bolt 14 when the outside lever handle 18 is inoperable. The dead bolt 22 and key-operated mechanism may be of any conventional sort and form no part of the present invention.

As shown in FIGS. 2 and 3, the box-like mortise lock case comprises a bottom or back wall 28 and a cover or front wall 30 interconnected by a rear edge wall 29 and by a front edge face member 32 affixed by screws to the top and bottom edge walls of the rectangular case. The latch bolt 14 projects through the face member 32 and has a tailpiece 34 extending rearward from the head 33 of the bolt 14 through a reaction collar 36 fixed between the front and back walls 30,28 of the case. The tailpiece 34 is surrounded by a biasing spring 38 which acts between the latch bolt head 33 and the reaction collar 36. The tailpiece 34 extends therebeyond and carries a tail plate 39 at its rear end. The rear edge wall 29 of the case carries a stopbutton 44 in position to be engaged by the rear end of the tailpiece 34 when the head 33 of the latch bolt 14 is fully retracted.

An inside lock-operating hub 46 and an outside lock-operating hub 48 are mounted coaxially in bearing holes 50 and 52 in the front and back walls 30,28 of the case. Each hub has an axial square hole (not shown) to receive the end of a lever handle spindle 56 for connecting its associated inside or outside lever handle 16 or 18 to rotate the lock-operating hub 46 or 48.

The outside hub 48 carries a flange 58 having a slot 60 into which a stop plate 62 is projected when the upper of the two stopwork buttons 20 is depressed, so as to lock the outside lock-operating hub 48 against rotation. Depression of the lower button 21 releases the outside hub 48 for rotation by its lever handle 18. The inside hub 46 is cut away in the vicinity of such stopwork plate 62 so that it is freely rotatable under all conditions.

The stopworks bar 62 has ears at its edges which ride in slots in the front and back walls 30, 28 of the case, and such bar 62 extends forward and is fixed to the upper stopworks button 20 so that it will be moved into engagement with the slot 60 when that button is depressed. The lower stopworks button 21 is fixed to the forward end of a second bar 63 and the two bars are connected for opposite movement by a butterfly lever 65, the lower end of which is engaged with an overcenter spring 67. The lower stopworks button 21 is thus operative to retract the stopworks bar 62 from the slot 60 when such button is depressed, as shown in FIG. 2.

As shown in FIG. 2, the inside lock-operating hub 46 comprises a cam flange 66 formed with a section of a heart cam surface which includes a central valley 68 and laterally extending cam faces 70 and 72 which spiral outward in opposite directions from such valley 68. Preferably, the cam faces 70, 72 merge smoothly with each other at their points of tangency. The cam flange 58 of the outside lock-operating hub 48 is shaped with a heart cam surface identical with that of the inside lock-operating hub 46, and includes a central valley 68, partially shown in FIG. 3, and opposite outward-spiralling faces like the cam faces 70 and 72 of the inside hub and in alignment therewith.

As shown best in FIG. 4, each of the inside and outside lock-operating hubs 46, 48 is formed to include an upper notch 80 in proximity to cam surface 72 and a complementary lower notch 82 in proximity to cam surface 70. The side wall of each notch 80, 82 in closest proximity to the cam surfaces 70 and 72 is shaped to provide a hub camming surface 84.

A pair of elongated hub bias arms **86*a* and 86*b* are pivotally mounted on a bias pin 90 in side-by-side relation so the each bias arm is independently pivotable to engage one of the inside and outside hubs. Each of bias arms 86*a*, 86*b* is shaped to provide a bias arm camming surface 92. The pair of pivotable bias arms 86*a*, 86*b* are situated within the case to enable the bias arm camming surface 92 of each bias arm to engage and operate on the hub camming surface 84** of its companion hub.

Each bias arm is loaded with a torsional hub spring 94. Each hub spring 94 includes a first leg 96 in engagement with the inwardly-facing surface of side edge wall 98, and a second leg 100 in engagement with a protrusion 102 rigidly fixed on each of bias arms **86*a* and 86*b*. As shown in FIGS. 2 and 4, each bias arm is loaded with its own torsional hub spring 94 normally to cause the bias arm camming surface 92 to operate on the neighboring hub camming surface 84 of the bias arm's companion lock-operating hub 46 or 48. A stop pin 104 is mounted within the case in proximity to cam face 70 to block rotation of each hub 46, 48 past that point. Thus, each torsional spring 94 loads it companion hub bias arm 86*a* or 86*b* causing said hub bias arm to rotate its companion lock-operating hub to its limit position as illustrated in FIG. 2**.

A retraction lever 110 is pivotally mounted on a pivot pin 112 extending between the front and back walls 30, 28 of the case and extends therefrom upward and forward past the hubs 46 and 48. The retraction lever 110 is formed at its upper end with a first lever nose 114 which lies between the tailpiece 34 and the back wall 28 of the case and in engagement with the tail plate 39 of the latch bolt 14. A downwardly extending second lever nose 116 may lie between the tailpiece 34 and the front wall 30 of the case to actuate the latch bolt 14 from the key-actuated mechanism 26 which is not relevant to the present invention. The retraction lever 110 is formed at an intermediate point in its length to include a thick portion 118 which carries spaced side walls 120 and 122. These form a yoke in which a roller 124 is mounted by means of a relatively small pin or shaft 126. The roller 124 is adapted to seat in the central valleys 68 of the cam flanges 66 and 58 of the two hubs 46 and 48, and to serve as a cam follower of the cam surfaces 70 and 72 on such flanges. The retraction lever 110 includes a lug 128. A torsional or ribbon-type pivot spring 130 is mounted on the retraction lever 110 in proximity to the pivot pin 112 to bias the retraction lever 110 toward the hubs. The pivot spring 130 includes one leg in contact with the lug 128 and another leg in contact with the inwardly facing surface of the side edge wall 98.

The inside lock-operating hubs 46 operates in the manner set forth below. It will be appreciated that the complementary outside lock-operating hub 48 operates in a similar manner. As described above, a torsional hub spring 94 causes the inside hub to be rotatably moved and biased against the fixed stop pin 104. Further, the retraction lever 110 is normally biased by pivot spring 130 toward the coaxial inside and outside hubs 46 and 48 so that roller 124 rests in the valleys 68 of the cam flanges of those hubs. Still further, the latch bolt 14 is normally biased to its projected position by its biasing spring 38.

The inside lever handle 16 may be rotated counterclockwise from the position shown in FIG. 2 to carry the cam surface 72 against the roller 124 and to force the retraction lever 110 to pivot rearward so that its nose 114 forces the tail plate 39 and the tailpiece 34 of the latch bolt 14 to a retracted position. At this point, the door on which the mortise lock is mounted may be opened. It will be understood that the latch bolt 14 will be returned to its normal projected position by the conventional biasing spring 38 and the retraction lever 110 will be biased to its normal position by pivot spring 130. Further, the novel spring return means of the present invention returns the inside lock-operating hub independent of any rotational movement of the outside lock-operating hub, from its rotated position to its normally biased position against the stop pin 104.

Figure 7:
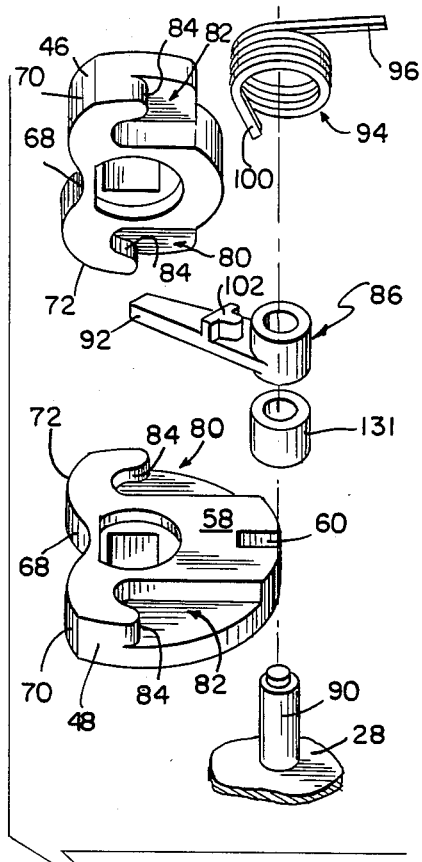
FIG. 7 is an exploded assembly view of the hubs installed in the embodiment of FIG. 6.
Figure 8:
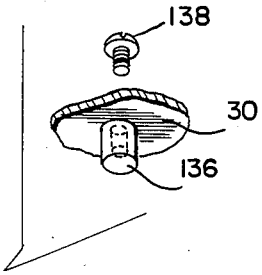
FIG. 8 is a view of the short hub stop pin installed in the embodiment of FIG. 6.

In the embodiment of the invention illustrated in FIGS. 6, 7 and 8, those elements numbered identically with the embodiment of FIGS. 1 to 5 perform the same or similar functions. In the embodiment of FIGS. 6, 7 and 8, a mortise lock is furnished with a "lever/knob" grip combination. Typically, it is desirable to replace the outside lever handle with a conventional knob to improve the security of the lock by eliminating "wedging surfaces" provided by the lever handle which may be used by a lock-breaking burglar to defeat the lock. However, it is often desirable or manditory under the law to retain the inside lever handle to maintain ease of operation.

Figure 10:
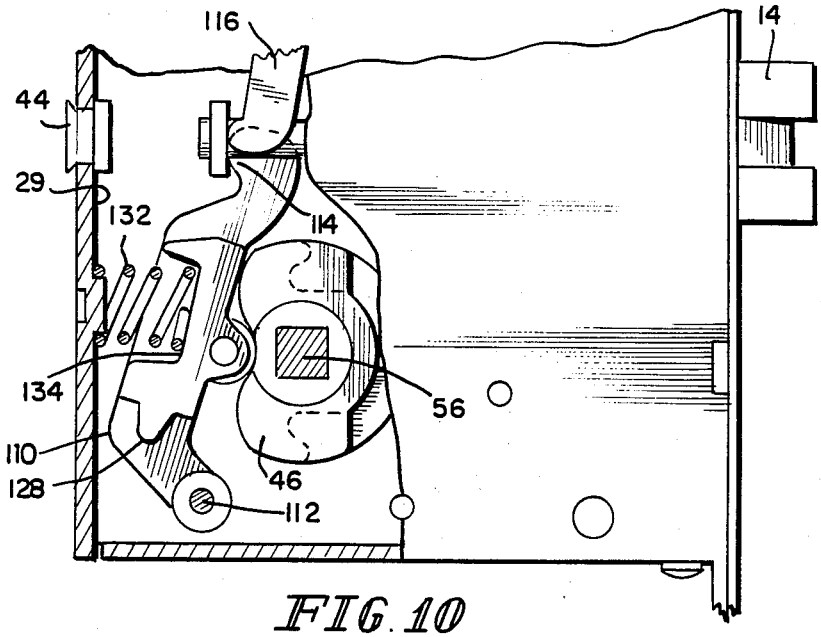

The improved mortise lock of the present invention may be easily changed from a "lever/lever" grip combination to a "lever/knob" grip combination in the following manner. To replace the outside lever handle with a conventional knob only three steps need be taken. First, the hub bias arm **86*b* which operates on the outside hub 48 and its companion torsional hub spring 94 are removed to disable the lever handle return system. A cylindrical sleeve 131 is inserted in place of the hub bias arm 86*b* as shown in FIG. 7. Second, the outside lever handle 18 is removed and replaced by a conventional knob 19. It will be understood that pivot spring 130 is sufficient to return a conventional knob. However, in lieu of the pivot spring 130, a compression spring 132 can be installed between the rear edge wall 29 and a cavity 134 in the thick portion 118 of the retraction lever as shown in FIG. 10. Third, the long stop pin 104 shown in FIG. 5 is removed and a short stop pin 136 is fixed in its place by a screw 138 as shown in FIG. 8. The short stop pin 136 is positioned only to block rotation of the lever handled inside lock-operating hub. Thus, the newly installed knob 19 may be rotated in either direction to retract the latch bolt 14**.

Figure 9:
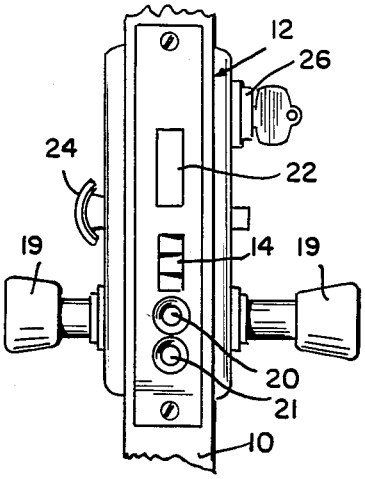
FIG. 9 is an edge elevation of a door fitted with a third embodiment of a mortise lock constructed in accordance with the present invention showing inside and outside doorknobs; and, FIG. 10 is a horizontal section similar to that shown in FIG. 3 showing the compression spring means for biasing the retraction lever and a non-biased inside lock-operating hub.

In the embodiment of the invention illustrated in FIGS. 9 and 10, those elements numbered identically with the embodiment of FIGS. 1 to 5 perform the same or similar functions. In the embodiment of FIGS. 9 and 10, a mortise lock is furnished with a "knob/knob" grip combination. This embodiment is shown to illustrate the environment of a mortise lock into which the novel inside and outside lock-operating hubs 46 and 48 have been inserted. Thus, the improved mortise lock of the present invention may be easily changed from a "lever/knob" grip combination to a "knob/knob" grip combination by removing the remaining hub bias arm assembly and removing the short stop pin 136.

Although the invention has been described in detail with references to certain preferred embodiments and specific examples, variations and modifications exist within the scope and spirit of the invention as described and defined in the following claims.

What is claimed is:

1. A mortise lock comprising:

a case, a latch bolt, first spring means for yieldably biasing the latch bolt from a retracted position to a projected position, a retraction lever for retracting the latch bolt, means for pivotally mounting the retraction lever in the case to permit the retraction lever to be pivoted from a first position to a second position to cause the latch bolt to move toward its retracted position, second spring means for yieldably biasing the retraction lever toward its first position such that the latch bolt remains in its projected position, inside and outside operating hubs coaxially aligned and independently rotatably mounted in the case, each operating hub being rotatable in at least one direction toward a rotated position and including at least one hub camming surface and cam means for engaging the retraction lever to cause said lever to pivot and retract the latch bolt in response to rotation of one of the inside and outside operating hubs, and third spring means for yieldably biasing at least one of the operating hubs to return from a rotated position, the third spring means including at least one bias arm having a bias arm camming surface, and means for pivotally mounting the at least one bias arm in the case to permit the bias arm camming surface to operate on a selected one of the hub camming surfaces to subsequently cause the retraction lever to pivot toward its first position to move the latch bolt to its projected position.

2. The mortise lock of claim 1 wherein the third spring means further includes at least one hub spring having one leg engaging one of the at least one bias arms to cause the bias arm camming surface to operate on the selected one of the hub camming surfaces whereby such operation returns the at least one of the operating hubs from a rotated position to subsequently cause the retraction lever to pivot toward its first position to move the latch bolt to its projected position.

3. The mortise lock of claim 2 wherein the at least one hub spring is a torsion spring.

4. The mortise lock of claim 1 further comprising stop means for blocking rotation of the at least one of the operating hubs at a selected stop point as the at least one of the operating hubs is biased by the third spring means to return from a rotated position toward the selected stop point.

5. The mortise lock of claim 4 wherein the stop means includes a stop pin situated within the case and rigidly fixed thereto normally to engage the cam means of the at least one of the operating hubs at the selected stop point.

6. The mortise lock of claim 1 wherein the retraction lever includes a nose member, and the second spring means includes a pivot spring having one leg engaging the nose member normally to bias the pivotable retraction lever toward its first position.

7. The mortise lock of claim 6 wherein the pivot spring is one of a torsion spring and a ribbon spring.

8. A mortise lock comprising:

a case, a latch bolt including a tailpiece, first spring means for yieldably biasing the latch bolt from a retracted position to a projected position, a retraction lever for retracting the latch bolt, means for pivotally mounting the retraction lever in the case to engage the tailpiece and to permit the retraction lever to be pivoted from a first position to a second position to cause the latch bolt to move toward its retracted position, second spring means for yieldably biasing the retraction lever toward its first position such that the latch bolt remains in its projected position, inside and outside operating hubs coaxially aligned and independently rotatably mounted in the case, each operating hub being rotatable in at least one direction toward a rotated position and formed to include at least one notch having a hub camming surface and including cam means for engaging the retraction lever to cause said lever to pivot and retract the latch bolt in response to rotation of one of the inside and outside operating hubs, and third spring means for yieldably biasing at least one of the operating hubs to return from a rotated position, the third spring means including at least one bias arm having a bias arm camming surface, and means for pivotally mounting the at least one bias arm in the case to permit the bias arm camming surface to operate on a selected one of the hub camming surfaces to subsequently cause the retraction lever to pivot toward its first position to move the latch bolt to its projected position.

9. The mortise lock of claim 8 wherein the third spring means further includes at least one hub spring having one leg engaging one of the at least one bias arms to cause the bias arm camming surface to operate on the selected one of the hub camming surfaces whereby such operation returns the at least one of the operating hubs from a rotated position to subsequently cause the retraction lever to pivot toward its first position to slide the latch bolt to its projected position.

10. The mortise lock of claim 9 wherein the at least one hub spring is a torsion spring.

11. The mortise lock of claim 9 wherein the mounting means includes a pivot pin fixed to the case and one of a spacer sleeve and a bias arm.

12. A mortise lock comprising:

a case having front and back side walls and an edge face, a latch bolt including a tailpiece, support means for slidably mounting the latch bolt between the side walls, first spring means for yieldably biasing the latch bolt from a retracted position to a projected position through the edge face, a retraction lever, means for pivotally mounting the retraction lever in the case to engage the tailpiece and to permit the retraction lever to be pivoted from a first position to a second position to cause the latch bolt to move toward its retracted position, second spring means for yieldably biasing the retraction lever toward its first position such that the latch bolt remains in its projected position, inside and outside operating hubs coaxially aligned and rotatably mounted in the case, each operating hub being rotatable in at least one direction toward a rotated position and formed to include at least one notch having a hub camming surface and including cam means for engaging the retraction lever to cause said lever to pivot and retract the latch bolt in response to rotation of one of the inside and outside operating hubs, and third spring means for yieldably biasing at least one of the operating hubs to return from a rotated position, the third spring means including at least one bias arm having a bias arm camming surface, spacer means for pivotally mounting the at least one bias arm to the case to permit the bias arm camming surface to operate on a selected one of the hub camming surfaces, and at least one hub spring having one leg engaging the case and the other leg engaging one of the at least one bias arms to cause the bias arm camming surface to operate on the selected one of the hub camming surfaces whereby such operation returns the at least one of the operating hubs from a rotated position to subsequently cause the retraction lever to pivot toward its first position to slide the latch bolt to its projected position.

13. The mortise lock of claim 12 wherein the at least one hub spring is a torsion spring.

14. The mortise lock of claim 12 further comprising stop means for blocking rotation of the at least one of the operating hubs at a selected stop point as the at least one of the operating hubs is biased by the third spring means to return from a rotated position toward the selected stop point.

15. The mortise lock of claim 14 wherein the stop means includes a stop pin situated within the case and rigidly fixed thereto normally to engage the cam means of the at least one of the operating hubs at the selected stop point.

16. The mortise lock of claim 12 wherein the retraction lever includes a nose member, and the second spring means includes a pivot spring having one leg engaging the case and the other leg engaging the nose member normally to bias the pivotable retraction lever toward its first position.

17. The mortise lock of claim 16 wherein the pivot spring is a torsion spring.

18. The mortise lock of claim 12 wherein the spacer means includes a pivot pin fixed to the case and one of a spacer sleeve and a bias arm.

* * * * *